US007784590B2

(12) United States Patent
Watanabe et al.

(10) Patent No.: US 7,784,590 B2
(45) Date of Patent: Aug. 31, 2010

(54) ELEVATOR OPERATION CONTROL DEVICE

(75) Inventors: Seiji Watanabe, Chiyoda-ku (JP); Daiki Fukui, Chiyoda-ku (JP); Takashi Yumura, Chiyoda-ku (JP); Hideki Nishiyama, Chiyoda-ku (JP); Hideki Shiozaki, Chiyoda-ku (JP)

(73) Assignees: Mitsubishi Denki Kabushiki Kaisha, Tokyo (JP); Mitsubishi Electric Building Techno-Service Co., Ltd., Tokyo (JP)

( * ) Notice: Subject to any disclaimer, the term of this patent is extended or adjusted under 35 U.S.C. 154(b) by 400 days.

(21) Appl. No.: 11/996,141

(22) PCT Filed: Mar. 1, 2006

(86) PCT No.: PCT/JP2006/303857

§ 371 (c)(1),
(2), (4) Date: Jan. 18, 2008

(87) PCT Pub. No.: WO2007/099619

PCT Pub. Date: Sep. 7, 2007

(65) Prior Publication Data

US 2009/0114484 A1 May 7, 2009

(51) Int. Cl.
*B66B 1/34* (2006.01)

(52) U.S. Cl. ..... 187/393; 187/388

(58) Field of Classification Search ..... 187/247, 187/380–388, 391–393
See application file for complete search history.

(56) References Cited

U.S. PATENT DOCUMENTS 4,998,601 A * 3/1991 Suzuki ..... 187/278

FOREIGN PATENT DOCUMENTS

| | | | |
|---|---|---|---|
| JP | 53 107048 | | 9/1978 |
| JP | 56 082779 | | 7/1981 |
| JP | 57 27878 | | 2/1982 |
| JP | 61 114982 | | 6/1986 |
| JP | 2005 324890 | | 11/2005 |
| JP | 2007131360 | A * | 5/2007 |
| JP | 2008114944 | A * | 5/2008 |
| JP | 2008114945 | A * | 5/2008 |
| JP | 2009220994 | A * | 10/2009 |

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

In a control operation performed at time of an earthquake or strong wind, when a running elevator is stopped at a nearest floor, the natural frequency of the transverse vibration of a rope is prevented from resonating with the natural frequency of the building, and thereby an increase in transverse vibration of the rope is restrained. In the control operation, when a shake of the building caused by earthquake or strong wind is detected, a running elevator is stopped at the nearest floor, or an elevator passing through an express zone is stopped emergently and runs at a low speed to the nearest floor, the natural frequency of the transverse vibration of the rope is compared with the natural frequency of the building, and the car stop position is selected at a non-resonance position to prevent the natural frequency of the transverse vibration of the rope from resonating with the natural frequency of the building.

12 Claims, 4 Drawing Sheets

ELEVATOR OPERATION CONTROL DEVICE

TECHNICAL FIELD

The present invention relates to an elevator operation control device that performs a control operation at the time of earthquake or strong wind.

BACKGROUND ART

In the case where an earthquake having a relatively long period occurs or at the time of strong wind, a building continues to shake for a long period of time at a low (first-order) natural frequency. Usually, if the vibration of building exceeds a vibration level set by a seismic sensor, the operation of elevator transfers to a control operation. In this control operation, the running elevator is stopped at the nearest floor to prevent passengers from being trapped in the car.

On the other hand, in the shaft of elevator, long objects such as a main rope for driving the elevator, a compensating rope, a governor rope, and traveling cable are provided, and each rope is transversely vibrated by the shake of building. In particular, if the natural frequency of the transverse vibration of rope coincides with the natural frequency of building and resonances occur, the shake amount of rope increases with time, so that the equipment in the elevator shaft may be damaged by the contact of rope with the equipment, the rope may be caught by something, or other troubles may occur.

Since the natural frequency of the transverse vibration of rope depends on the tension of the rope and the rope length determined by the position of a car, it is necessary to properly select the stop position of the car to prevent the resonance of the transverse vibration of the rope with the shake of building.

As an elevator operation control device at the earthquake time, a device has conventionally been known in which if preliminary tremors of earthquake are detected, it is judged whether the car is located above or below the intermediate floor of the building, and if the car is located above the intermediate floor of the building, the car is moved to the intermediate floor and stopped there, and if the car is located below the intermediate floor of the building, the car is stopped at the nearest floor and then is moved to the intermediate floor and stopped there (for example, refer to Patent Document 1).

Also, as another conventional art, for some elevator operation control devices, the car is stopped at a position at which the main rope does not resonate (non-resonance position) (for example, refer to Patent Document 2).

Patent Document 1: Japanese Patent Laid-Open No. 57-27878

Patent Document 2: Japanese Patent Laid-Open No. 56-82779

DISCLOSURE OF THE INVENTION

Problems to be Solved by the Invention

In the conventional elevator operation control device at the earthquake time, even if the transverse vibration of main rope does not resonate at the intermediate floor, the compensating rope or the governor rope is often resonated by the shake of the building in the vicinity of the intermediate floor, so that there arises a problem in that the stopping of the car at the intermediate floor is not necessarily the best condition for preventing the transverse vibration of rope.

Also, in the aforementioned Patent Document 2, a specific method for moving the car to a position at which the main rope does not resonate (non-resonance position) is not described, and the compensating rope, the governor rope, or the like other than the main rope may resonate before the car is stopped.

The present invention has been made to solve the above problems, and accordingly an object thereof is to provide an elevator operation control device in which in a control operation performed at the time of earthquake or strong wind, when the running elevator is stopped at the nearest floor, the natural frequency of the transverse vibration of rope is prevented from resonating with the natural frequency of the building, and hence the increase in transverse vibration of the rope is restrained.

Means for Solving the Problems

An elevator operation control device in accordance with the present invention that performs a control operation to stop a running elevator at the nearest floor when the shake of a building caused by earthquake or strong wind is detected is characterized in that the device includes a rope resonance checking means that compares the natural frequency of the transverse vibration of a rope with the natural frequency of the building, and selects the car stop position at a non-resonance position so as to prevent the natural frequency of the transverse vibration of the rope from resonating with the natural frequency of the building.

Also, an elevator operation control device in accordance with the present invention that performs a control operation to emergently stop an elevator passing through an express zone when the shake of a building caused by earthquake or strong wind is detected and to run the elevator at a low speed to the nearest floor is characterized in that the device includes a rope resonance checking means that compares the natural frequency of the transverse vibration of a rope with the natural frequency of the building, and makes the emergency stop position of the elevator passing through the express zone a non-resonance position at which the natural frequency of the transverse vibration of the rope does not resonate with the natural frequency of the building.

Also, when an elevator running at a low speed toward the nearest floor passes through a resonance position, the rope resonance checking means raises the speed of elevator to cause the elevator to pass through the resonance position rapidly.

Also, when the nearest floor coincides with the resonance position, the rope resonance checking means does not stop the elevator at that floor, and stops the nearest non-resonance floor to drop passengers off.

Also, the rope resonance checking means has a rope natural frequency operating means that arithmetically operates the natural frequency of the transverse vibration of rope at the car position from a load weighing signal varied by the load weight, and information of its car position.

Also, the rope resonance checking means obtains the natural frequency of the building by regularly frequency-analyzing the building vibration data of a seismic sensor.

Further, in a check operation after earthquake, at a position at which the natural frequency of the transverse vibration of the rope resonates with the natural frequency of the building and at a loop position of the rope vibration at which the amplitude of the rope increases, the check operation is performed by running the elevator at a low speed, and in a zone other than these positions, the check operation is performed by running the elevator at a high speed.

Effect of the Invention

According to the present invention, in the control operation performed at the time of earthquake, strong wind, etc., when a running elevator is stopped at the nearest floor, the natural frequency of the transverse vibration of a rope can be prevented from resonating with the natural frequency of the building, and hence the increase in transverse vibration of the rope can be restrained.

DESCRIPTION OF SYMBOLS

Figure 1:
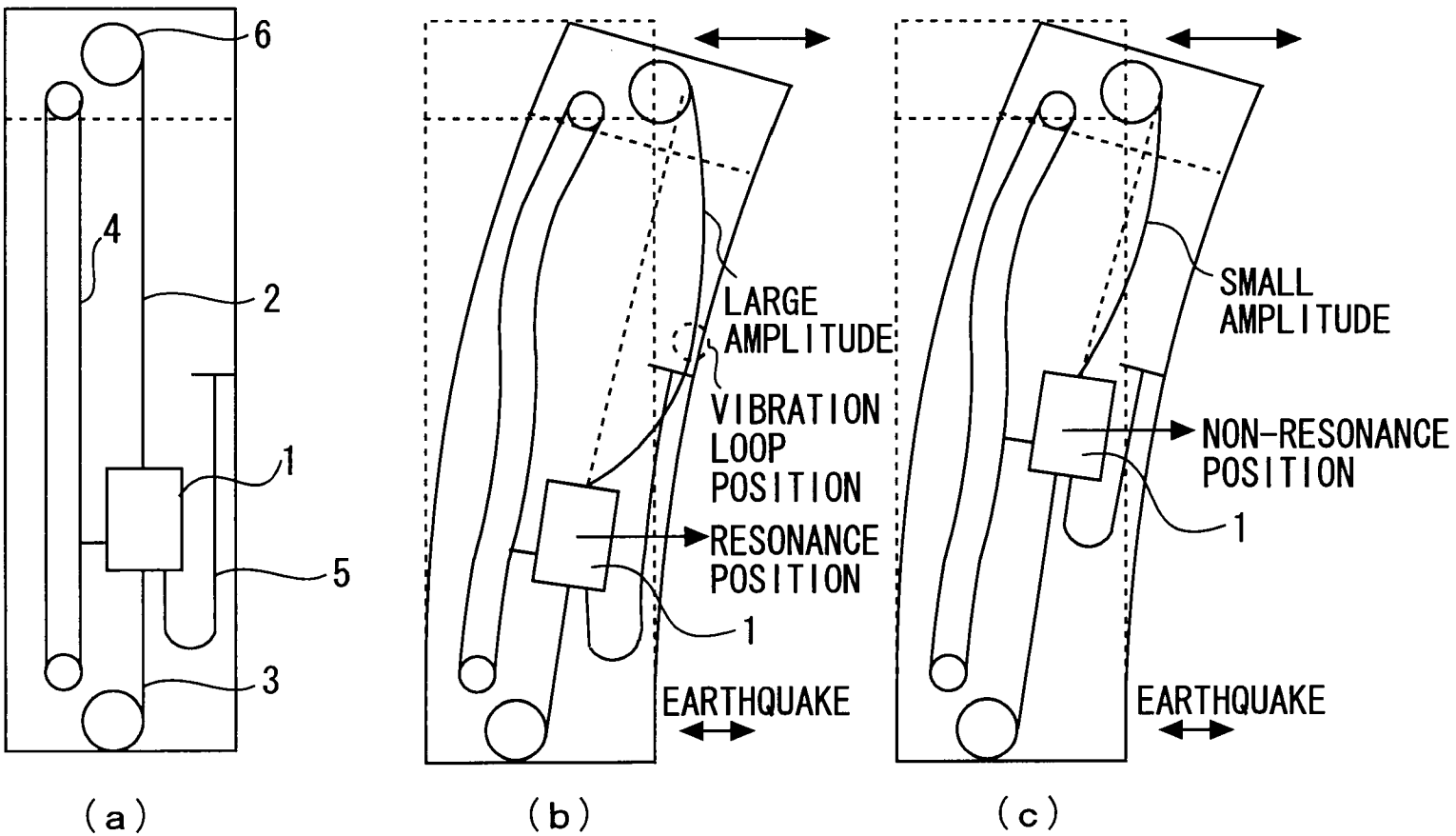
FIG. 1 is a schematic view for explaining a resonance phenomenon of a rope with a building caused by an earthquake etc.

1 elevator car
2 main rope
3 compensating rope
4 governor rope
5 traveling cable
6 traction machine
7 car position
8 load weighing signal
9 rope natural frequency operating section
10 building natural frequency
11 natural frequency comparing section

BEST MODE FOR CARRYING OUT THE INVENTION

The present invention will now be described in more detail with reference to the accompanying drawings.

Embodiment 1

FIG. 1 is a schematic view for explaining a resonance phenomenon of a rope with a building caused by an earthquake etc. In FIG. 1, reference numeral 1 denotes an elevator car, 2 denotes a main rope, 3 denotes a compensating rope, 4 denotes a governor rope, 5 denotes a traveling cable, and 6 denotes a traction machine.

When the building is shaken by an earthquake or strong wind, the vibration often has the first-order natural frequency of building. Usually, if the vibration of the building exceeds a vibration level set by a seismic sensor, the operation of elevator transfers to a control operation.

In the control operation, the running elevator is stopped at the nearest floor to prevent passengers from being trapped in the car. In particular, when the elevator passing through an express zone cannot stop immediately at the nearest floor, the elevator stops emergently once, and then runs at a low speed in the direction in which the car 1 separates from a counterweight (not shown).

However, if the natural frequency of the transverse vibration of rope determined from the rope length determined from the emergency stop position and the rope tension determined from the total weight of the car including passengers coincides with the first-order natural frequency of the building, as shown in FIG. 1, the state turns from a normal state shown in FIG. 1(*a*) to a resonance state shown in FIG. 1(*b*), and great transverse vibrations of the rope occur. At this time, at a position of the rope vibration loop at which the amplitude of the rope is large, in particular, there is a fear that equipment in the elevator shaft may be damaged by the contact with the equipment. Also, as the stop time lengthens, the transverse vibration is expanded. Further, since the elevator runs at a low speed after stopping, the rope length does not change suddenly, and the resonating rope is still vibrated greatly in the transverse direction even during the low-speed running, which may hinder the running of elevator.

Generally, the natural frequency f [Hz] of the rope transverse vibration is given by the following formula.

$$f = \frac{1}{2L}\sqrt{\frac{T}{\rho}} \qquad \text{[Formula 1]}$$

Wherein, L is the length of the rope, T is the tension of the rope, and ρ is the linear density of the rope.

In the case where the rope is the main rope on the car side, the tension T thereof can be determined from the weight of the car and the output of a load weighing device. Also, in the case where the rope is the main rope on the counterweight side, the tension T can be determined from the weight of counterweight.

The rope length L can be calculated based on the present car position. The linear density of the rope can be stored as prior information. Therefore, if the car position and the weight of passengers are found, the natural frequency of the transverse vibration of each rope at the present car position can be monitored in real time. On the other hand, the natural frequency of the building is stored in advance, or it can be updated to the latest value by regularly frequency-analyzing the building vibration data of the seismic sensor etc.

Since the building vibration information and the rope transverse vibration information can be understood in advance by the car position and the passenger weight, the rope length L, namely, the car position such that the rope transverse vibration and the building vibration do not resonate with each other can be determined. For example, as shown in FIG. 1, if the car is located at a non-resonance position shown in FIG. 1(*c*), the transverse vibration (amplitude) of the rope can be kept small.

Figure 2:
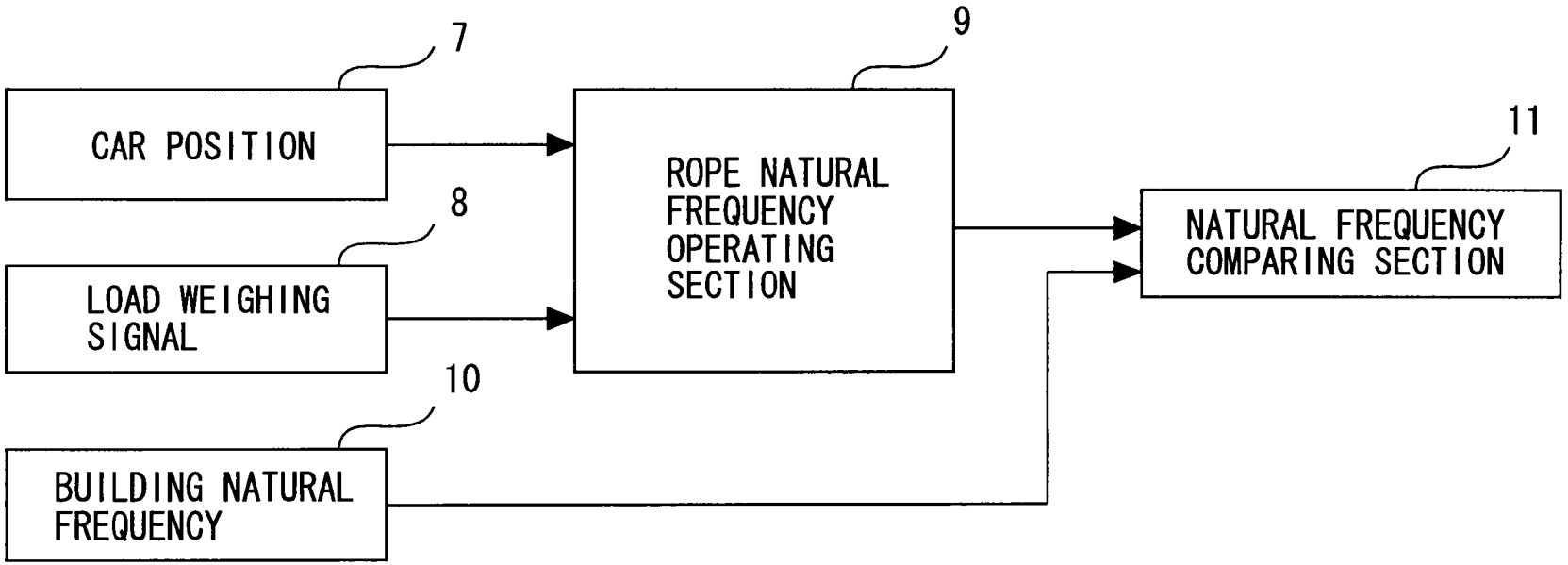
FIG. 2 is a block diagram showing a rope resonance checking means of an elevator operation control device in the embodiment 1 of the present invention.

Thereupon, when the elevator operation transfers to the control operation, a rope resonance checking means shown in FIG. 2 is operated. This rope resonance checking means includes a rope natural frequency operating section 9 for arithmetically operating the rope natural frequency from a car position 7 and a load weighing signal 8 and a natural frequency comparing section 11 for comparing the operation result of the rope natural frequency operating section 9 with a building natural frequency 10. The rope natural frequency is compared with the building natural frequency, and if the difference between the natural frequencies is not more than a certain value, the rope resonance checking means judges that the car is located at the resonance position.

Figure 3:
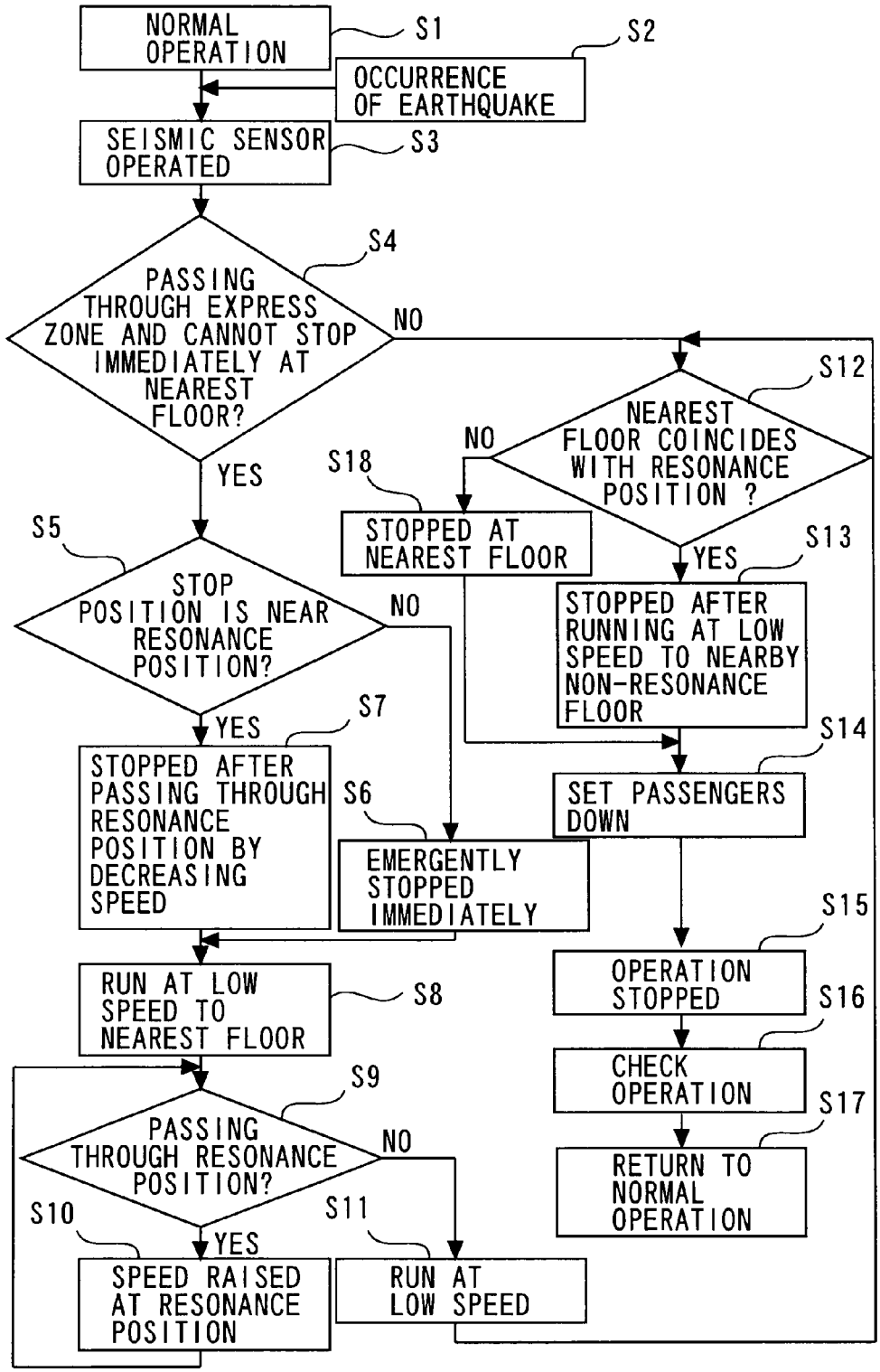
FIG. 3 is a flowchart for explaining the operation of an elevator operation control device in the embodiment 1 of the present invention.

Next, the operation flow in the case where the elevator control operation is performed due to earthquake or strong wind is explained with reference to FIG. 3.

If an earthquake occurs (Step S2) during the normal operation (Step S1), the seismic sensor operates (Step S3). Next, in Step S4, it is judged whether or not the elevator is an elevator passing through the express zone and cannot stop immediately at the nearest floor. If it is judged in Step S4 that the elevator cannot stop immediately at the nearest floor, the control proceeds to Step S5, where it is judged whether or not the position at which the car is stopped emergently by the rope resonance checking means is the resonance position. If it is judged in Step S5 that the car stop position is the non-resonance position, the car is emergently stopped immediately (Step S6). On the other hand, if the car stop position is near the resonance position in Step S5, the stop position is set at the non-resonance position by the rope resonance checking means, and the car is stopped after passing through the resonance position while decreasing the speed (Step S7). Subsequently, the car runs at a low speed to the nearest floor (Step S8).

Even if the emergently stopping position is not the resonance position, there is a possibility that the car passes through the rope resonance position during the time when the car moves at a low speed to the nearest floor. In this case, in Step S9, it is judged whether or not the car passes through the position at which the rope resonates. When the car passes through the resonance position, the car speed in the vicinity of the resonance position is raised (Step S10). At other non-resonance positions, the car runs at a low speed, and arrives at the nearest floor (Step S11). Thereby, the time during which the rope resonates can be shortened, and the transverse vibrations of rope can be restrained as far as possible.

Further, if it is judged in Step S4 that the car can be stopped immediately at the nearest floor, or if the car runs at a low speed in Step S11 and arrives at the nearest floor, it is judged whether or not the nearest floor coincides with the resonance position determined by the rope resonance checking means (Step S12). If the nearest floor coincides with the resonance position, the car does not stop at that floor, moving at a low speed to the next floor, and stops at a nearby non-resonance floor away from the resonance position (Step S13), setting the passengers down (Step S14), and the operation is stopped (Step S15). Thereby, an increase in the transverse vibration of the rope at the time when the car stops at the nearest floor can be restrained. Subsequently, going through a check operation (Step S16), the elevator operation returns to the normal operation (Step S17). Also, if it is judged in Step S12 that the nearest floor does not coincide with the resonance position, the car stops at the nearest floor (Step S18).

As the first-order natural frequency of the building, a frequency determined by a horizontal bidirectional translational vibration mode and a frequency determined by a rotational vibration mode around the vertical axis are present, and these natural frequencies generally take different values. Therefore, in order to judge whether the transverse vibration of the rope resonates with the vibration of the building, it is necessary to make comparison between the vibrations of the building. In this description, the first-order natural frequency of the building is described. However, if a natural frequency of second or more order of the building is considered, the transverse vibration of the rope can be restrained more surely.

Embodiment 2

When the building shakes greatly, after the elevator has stopped at the nearest floor, the operation of elevator stops until the time of maintenance and check (Step S15), so that the service to passengers becomes poor significantly. Therefore, it is important to finish the maintenance and check quickly.

Figure 4:
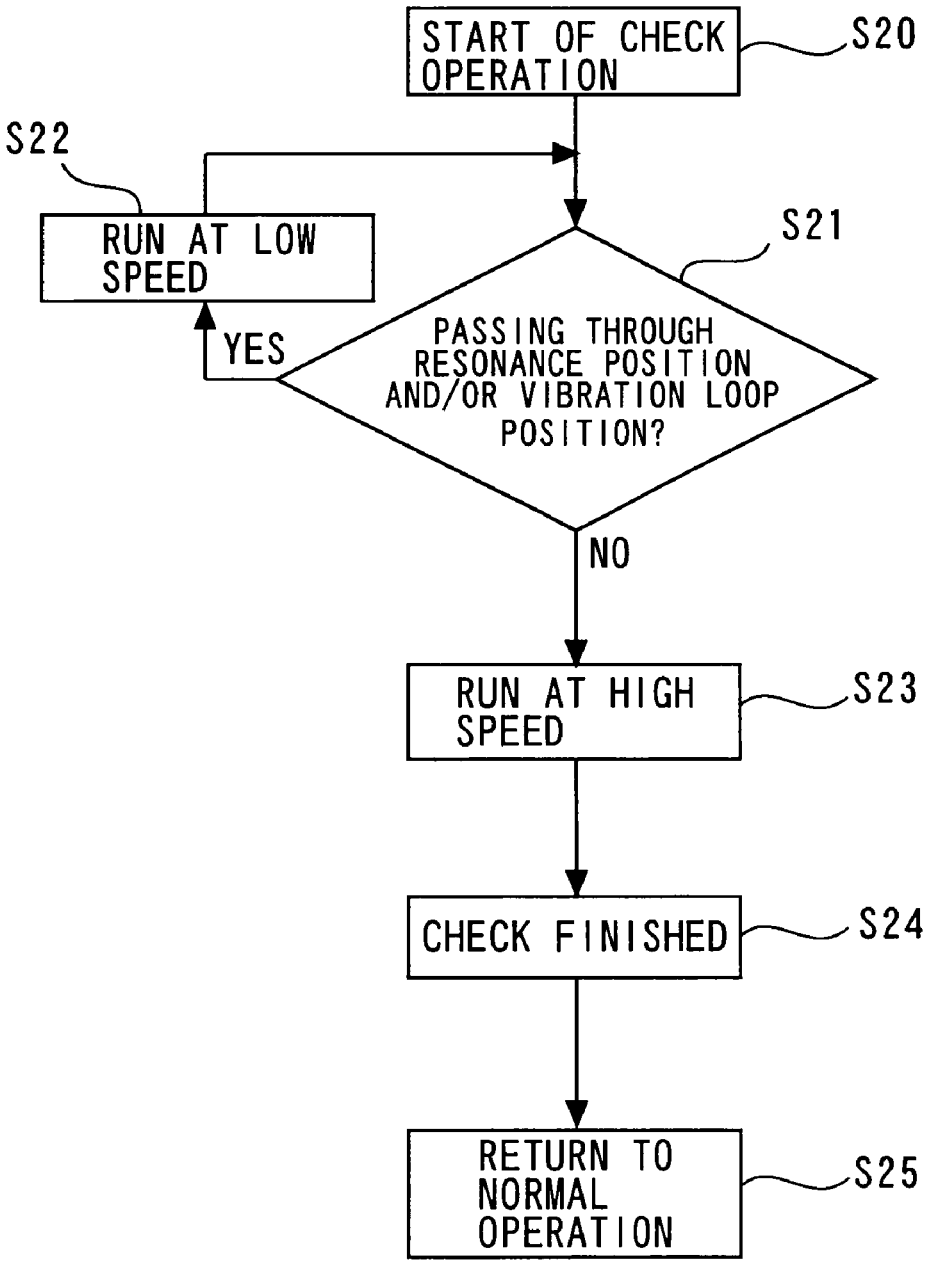
FIG. 4 is a flowchart for explaining the check operation after earthquake of an elevator operation control device in the embodiment 2 of the present invention.

FIG. 4 is a flowchart for explaining the check operation of the elevator after the occurrence of earthquake. As a trouble caused by the great shake of the building, the rope may be caught by something as a result of the transverse vibration of the rope, or the equipment in the elevator shaft may be damaged by the contact of the rope with the equipment. In the embodiment 2, therefore, as shown in FIG. 4, at the start of check operation after the occurrence of earthquake (Step S20), the rope resonance checking means is operated to judge whether or not the car passes through a position at which the transverse vibration of the rope resonates with the vibration of the building and/or a vibration loop position (refer to FIG. 1(*b*)) at which the transverse amplitude of the rope is at the maximum (Step S21). If the car passes through the resonance position and/or the vibration loop position, the car is run at a low speed to perform a close check (Step S22). If the car passes through a zone other than these positions, the check operation is performed during high-speed running (Step S23). After the check has been finished (Step S24), the elevator operation returns to the normal operation (Step S25). Thereby, the total check operation time can be shortened.

INDUSTRIAL APPLICABILITY

As described above, in the control operation performed at the time of earthquake, strong wind, etc., when the running elevator is stopped, the elevator operation control device in accordance with the present invention can prevent the natural frequency of the transverse vibration of the rope from resonating with the natural frequency of the building, and can hence restrain the increase in transverse vibration of the rope.

The invention claimed is:

1. An elevator operation control device that performs a control operation to stop a running elevator at a nearest floor when shake of a building caused by earthquake or strong wind is detected, comprising:

a rope resonance checking means that compares the natural frequency of the transverse vibration of a rope with the natural frequency of the building, and selects a car stop position at a non-resonance position so as to prevent the natural frequency of the transverse vibration of the rope from resonating with the natural frequency of the building.

2. The elevator operation control device according to claim 1, wherein when an elevator running at a low speed toward the nearest floor passes through a resonance position, the rope resonance checking means raises the speed of elevator to cause the elevator to pass through the resonance position rapidly.

3. The elevator operation control device according to claim 1, wherein when the nearest floor coincides with a resonance position, the rope resonance checking means does not stop the elevator at that floor, and stops the elevator at a nearest non-resonance floor to drop a passenger off.

4. The elevator operation control device according to claim 1, wherein the rope resonance checking means has a rope natural frequency operating means that arithmetically operates the natural frequency of the transverse vibration of the rope at the car position from a load weighing signal varied by the load weight, and information of its car position.

5. The elevator operation control device according to claim 1, wherein the rope resonance checking means obtains the natural frequency of the building by regularly frequency-analyzing building vibration data of a seismic sensor.

6. The elevator operation control device according to claim 1, wherein in a check operation after earthquake, at a position at which the natural frequency of the transverse vibration of the rope resonates with the natural frequency of the building and at a loop position of rope vibration at which the amplitude of the rope increases, the check operation is performed by running the elevator at a low speed, and in a zone other than these positions, the check operation is performed by running the elevator at a high speed.

7. An elevator operation control device that performs a control operation to emergently stop an elevator passing through an express zone when shake of a building caused by earthquake or strong wind is detected, and to run the elevator at a low speed to a nearest floor, comprising:

a rope resonance checking means that compares the natural frequency of the transverse vibration of a rope with the natural frequency of the building, and makes the emergency stop position of the elevator passing through the express zone a non-resonance position at which the natural frequency of the transverse vibration of the rope does not resonate with the natural frequency of the building.

8. The elevator operation control device according to claim 7, wherein when an elevator running at a low speed toward the nearest floor passes through a resonance position, the rope resonance checking means raises the speed of elevator to cause the elevator to pass through the resonance position rapidly.

9. The elevator operation control device according to claim 7, wherein when the nearest floor coincides with a resonance position, the rope resonance checking means does not stop the elevator at that floor, and stops the elevator at a nearest non-resonance floor to drop a passenger off.

10. The elevator operation control device according to claim 7, wherein the rope resonance checking means has a rope natural frequency operating means that arithmetically operates the natural frequency of the transverse vibration of the rope at the car position from a load weighing signal varied by the load weight, and information of its car position.

11. The elevator operation control device according to claim 7, wherein the rope resonance checking means obtains the natural frequency of the building by regularly frequency-analyzing building vibration data of a seismic sensor.

12. The elevator operation control device according to claim 7, wherein in a check operation after earthquake, at a position at which the natural frequency of the transverse vibration of the rope resonates with the natural frequency of the building and at a loop position of rope vibration at which the amplitude of the rope increases, the check operation is performed by running the elevator at a low speed, and in a zone other than these positions, the check operation is performed by running the elevator at a high speed.

* * * * *